US005275311A

United States Patent [19]

Piarrat

[11] Patent Number: 5,275,311

[45] Date of Patent: Jan. 4, 1994

[54] DISPENSING PACKAGING FOR PASTE PRODUCT

[76] Inventor: Jeffrey Piarrat, 23 Rue Boulay, 75017 Paris, France

[21] Appl. No.: 816,181

[22] Filed: Jan. 2, 1992

[30] Foreign Application Priority Data

Jan. 4, 1991 [BE] Belgium ..... 9100008

[51] Int. Cl.[5] ..... B65D 37/00

[52] U.S. Cl. ..... 222/209; 222/105; 222/95

[58] Field of Search ..... 222/95, 105, 183, 209, 222/212, 386.5

[56] References Cited

U.S. PATENT DOCUMENTS

| | | | |
|---|---|---|---|
| 2,777,612 | 1/1957 | Bensen | 222/209 |
| 3,118,572 | 1/1964 | Harding | 222/209 X |
| 3,223,289 | 12/1965 | Bouet | 222/209 |
| 3,306,500 | 2/1967 | Williams | 222/209 |
| 3,592,365 | 7/1971 | Schwartzman | 222/209 |
| 3,837,533 | 9/1974 | Splan | 222/209 X |
| 3,936,334 | 2/1976 | Kushida et al. | 156/69 |
| 4,020,978 | 5/1977 | Szczepanski | 222/209 |
| 4,226,337 | 10/1980 | Abbott | 222/107 |
| 4,469,250 | 9/1984 | Evezich | 222/95 X |
| 4,657,151 | 4/1987 | Cabernoch | 222/105 X |
| 5,108,007 | 4/1992 | Smith et al. | 222/209 X |

FOREIGN PATENT DOCUMENTS

| | | |
|---|---|---|
| 0305003A1 | 3/1989 | European Pat. Off. . |
| 0352348A1 | 1/1990 | European Pat. Off. . |
| 2164825 | 5/1973 | France . |
| 2407072 | 10/1977 | France . |

*Primary Examiner*—Kevin P. Shaver
*Attorney, Agent, or Firm*—Leonard Bloom

[57] ABSTRACT

The invention concerns the dispensing packagings for viscous, creamy or paste products, as well as a manufacturing method for these dispensing packagings. The body (6) of the packaging according to the invention, in substance tubular, comprises an interior envelope (8), apt for containing the product to be dispensed, and an exterior envelope (7) capable of yielding to the pressure and then to regain, in substance, its initial form. These two envelopes (7, 8) are coupled and united according to a line parallel, in substance to the axis of the body (6). The tubular body (6) thus formed is then welded, by one of its extremities, to a dispenser head (1), the other extremity being closed by a weld or placed on a base. The packaging according to the invention applies notably to cosmetic products, to health care products and to technical products.

13 Claims, 5 Drawing Sheets

FIG. 6
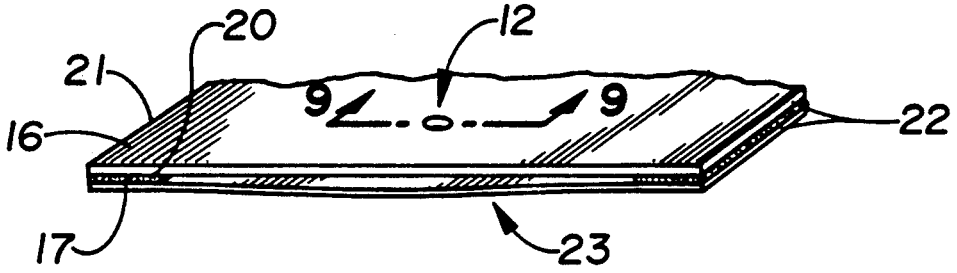
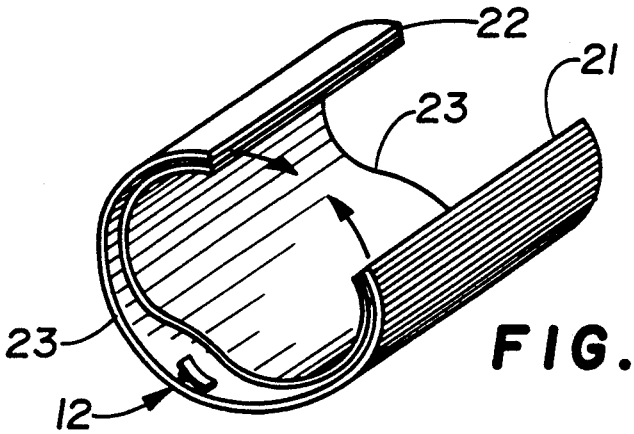
FIG. 7
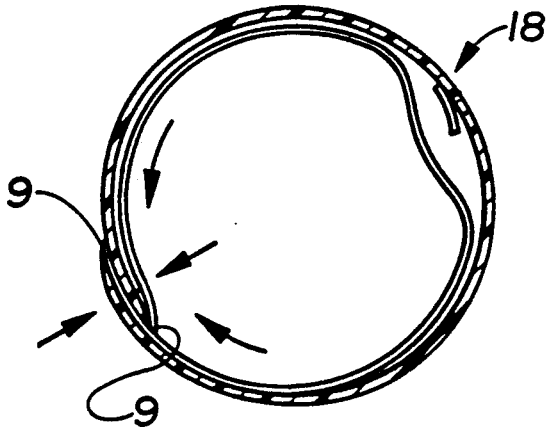
FIG. 8
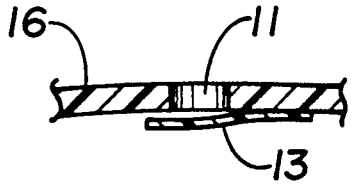
FIG. 9

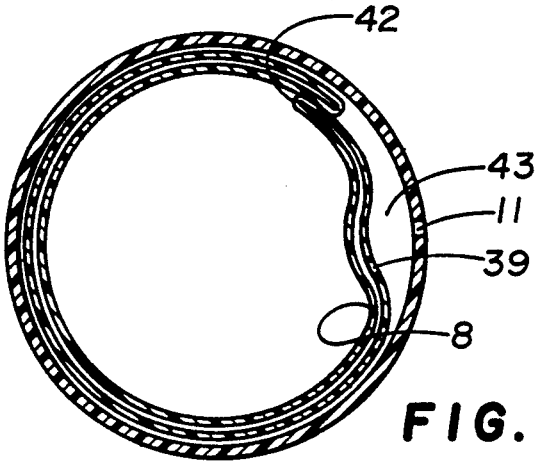
FIG. 17
FIG. 16
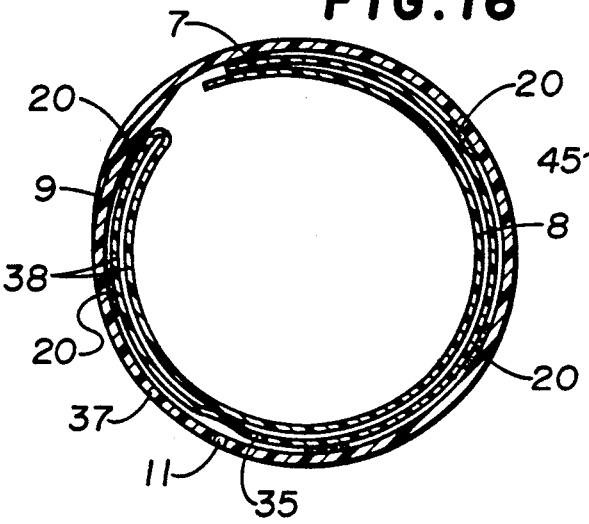
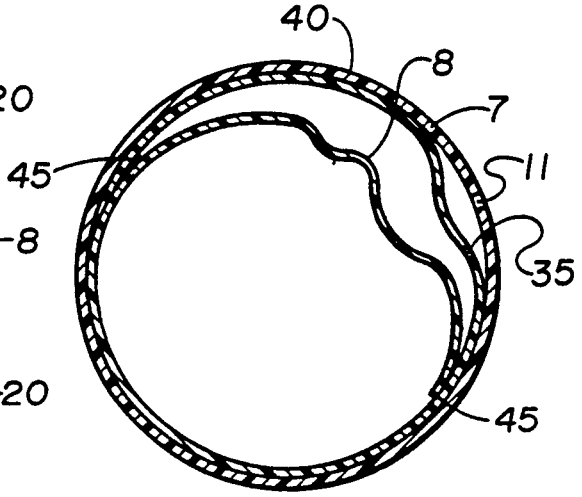
FIG. 18
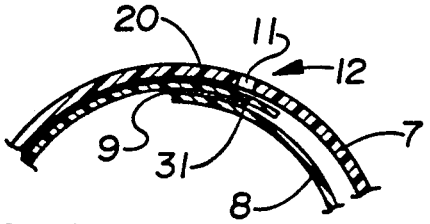
FIG. 20

DISPENSING PACKAGING FOR PASTE PRODUCT

The invention concerns dispensing packagings for viscous, creamy or paste products, as well as a manufacturing method for such recipients. The packagings according to the invention are particularly adapted to dispensing health care or cosmetic products in paste form.

BACKGROUND OF THE INVENTION

1) Scope of the invention

The cosmetics and health industry has for a long time been searching for relatively not onerous packagings capable of delivering their content, without requiring the use of excessive force by the user, and which maintain a pleasing exterior aspect until the end of their existence.

A well known problem of packaging of paste material, notably in cosmetics, but equally in other technical fields, is to limit in as far as possible the contact of the content with the ambient air, which accelerates the degradation of certain constituents. Containers in malaxable materials (metallic tubes) rapidly present a less attractive appearance. Rigid containers easily resume their form by sucking in air which replaces the paste which has just been extracted therefrom, which constitutes an inconvenience from the point of view of the degradation of the content and of its asepsis. New forms of packaging have been developed to avoid the inconveniences.

2) Description of the anterior art

The patent U.S. Pat. No. 4,842,165 describes an elastic walled bottle in which a pouch destined to enclose the product to be dispensed is suspended. This pouch is held in position half way up on the elastic wall. A non-return valve prohibits the product from re-descending into the pouch after compression. A second non-return device placed in the base of the bottle permits air to reenter between the bottle and the pouch when the compression has ceased.

The patent U.S. Pat. No. 4,909,416 describes a dispensing recipient of viscous products endowed with an exterior recipient capable of being pressed or deformed locally (structure in accordion) and a deformable interior pouch connected to a nozzle. This nozzle comprises a unidirectional valve prohibiting the reflux of the content towards the pouch. A second valve permits the introduction of air between the pouch and the exterior recipient.

A characteristic common to the recipients described in these two documents is vested in their relative complexity. These devices utilize relatively complex valves and interior and exterior envelopes which are manufactured distinctly and assembled for use. The cost of such recipients is therefore relatively high and is only justified for relatively onerous products or for particular uses.

A market exists for dispensing packagings for paste products which, while fully benefitting from the intrinsic qualities of this type of packaging, could be produced at a relatively low price.

BRIEF DESCRIPTION OF THE INVENTION

One of the objectives of the invention is precisely the production and the placing on the market of a dispensing packaging of viscous and paste products which keeps its form, which is easy to produce and of a low cost price.

Another objective of the invention is that this packaging, which would only serve one time, remains perfectly reliable the whole way through its utilization. Another objective is that the consumer is able to utilize it right to the end without excessive triturations.

The object of the invention is a dispensing packaging for paste or viscous product comprising a dispenser head and a body, the aforesaid dispenser head comprising a nozzle traversed by a discharge opening, obturable at its extremity by a detachable closure and connected by its other extremity to a flange;

The body, in substance tubular, extends according to an axis and comprises an interior envelope and an exterior envelope surrounding the aforesaid interior envelope, these two envelopes being closed at one extremity of the body and being, at the other extremity, connected to each other and at the periphery of the flange of the dispenser head, the interior envelope being supple and devoid of elastic memory and apt for containing a paste or viscous product;

The exterior envelope being more elastic and more rigid than the interior envelope, but nevertheless deformable under the effect of a manual compression force and capable of resuming its initial form in substance when the compression force ceases to be applied.

A non-return device prohibits the passage of air from the volume comprised between the exterior envelope and the interior envelope when the exterior envelope is compressed, but permits the passage of the ambient air towards this volume when the compression ceases to be applied.

The body of this packaging comprises two envelopes, the one more supple, towards the interior, the other more rigid, towards the exterior, these envelopes being united and merged with the flange of the dispenser head and thus held in position at the level of the aforesaid flange and on at least two points opposite the aforesaid dispenser head.

According to an advantageous realization form, the body is formed of two sheets of materials folded over in two according to an axis perpendicular to that of the aforesaid body, lap-welded on their sides extending according to the axis of the body, their free extremity being connected to the periphery of the flange of the dispenser head.

The body is advantageously constituted of sheets of materials rolled up on themselves around the axis according to which the aforesaid body extends, the aforesaid body comprising at least one weld in substance parallel to this axis, according to the lap-jointed line of the opposite edges of these sheets of material.

In preferred manner, the other extremity of the tubular body is formed by a weld; according to an alternative form, the other extremity of the tubular body is joined together at the periphery of the flange by a base.

Advantageously, two envelopes are constituted of one same material, but present a different thickness.

In advantageous manner, the two envelopes are constituted of a sheet of the same material folded over itself, the aforesaid sheet being originally curved, the part constituting the external envelope being folded in the direction of the original curve, the part constituting the internal envelope being folded in the opposite direction to the original curve, in a manner such that it presents a lesser rigidity and a lesser elastic memory than the part constituting the external envelope.

According to another execution form, the exterior envelope is formed of at least two underlayers; preferably, the two underlayers are identical and are joined together superficially to each other.

In advantageous manner, the interior envelope and the underlayers of the exterior envelope are identical to each other.

The interior envelope and the underlayers of the exterior envelope may furthermore constitute the successive folds of one same sheet of material.

According to another realization form, a median underlaying and the interior envelope are constituted of one same material and constitute, preferably, two folds of one same sheet of material.

In advantageous manner, the body of the packaging according to the invention comprises an external envelope without discontinuity, covering a median underlayer welded to which it is joined together and an interior envelope also welded, the whole formed by the exterior envelope and the median underlayer presenting a greater rigidity than that of the interior envelope.

The median underlayer and the internal envelope are preferably constituted of one same sheet of supple material, folded over itself in the direction of the width, the aforesaid sheet being rolled up on itself, parallel to the axis of the edges, the two free edges being attached to the fold of the sheet.

According to an advantageous realization form, the median underlayer and the interior envelope are constituted by one same sheet of material rolled up on itself by at least one turn at the interior of the exterior envelope, each extremity of the sheet parallel to the axis of the rolling up being joined together, by an axial weld, on the surface of the adjacent sheet.

In preferred manner, this sheet of material is rolled up on itself by at least one turn and a half at the interior of the exterior envelope.

The non-return device comprises, preferably, at least one orifice in the exterior envelope, a valving member disposed on the interior face of the exterior envelope facing the aforesaid at least one orifice, a zone where the exterior envelope and the interior envelope are not joined together surrounding the aforesaid at least one orifice and the aforesaid valving member.

According to another realization form, the non-return device comprises at least one orifice provided in the exterior envelope, the interior envelope being formed of a sheet of which the edges are lap-welded, the overlap of the edges of this sheet and the position of the weld being such that a free extremity subsists, at the exterior of the internal envelope, the external envelope and the internal envelope being joined together one in relation to the other in a manner such that the free extremity is disposed facing the orifice an forms valving member for the aforesaid orifice, this disposition forming a non-return device.

According to another execution form, the non-return device comprises at least one orifice pierced in the exterior envelope, at least one orifice pierced in the median layer, the overlap surface of supple material between these two orifices forming non-return valving member, a zone in which the exterior envelope and the median underlayer are not joined together surrounding the aforesaid valve.

According to another realization form, the non-return device comprises at least one orifice pierced along one lap-weld of two sheets, the edge of the overlapped sheet extending at least to plumb with this at least one orifice, in a manner to form a non-return valving member for this at least one orifice.

The object of the invention is also a manufacturing process of dispensing packagings which comprises the following operations:

superposition of two sheets of materials, one of these sheets being more rigid and more elastic than the second, the second being, inversely, more supple and devoid of elastic memory than the first;

fitting of a non-return device;

rolling up of these superposed sheets on themselves in a manner to form an approximately tubular body;

hermetic joint of the sides of the sheets extending according to the axis of this body;

closure of one of the extremities of this tubular body by joining together to each other, in hermetic manner, the layers of the external envelope and by joining together to each other the layers of the internal envelope;

joining together to each other the sides of the sheets forming the open extremity of the tubular wall;

joining together the open extremity of the tubular body with the flange of a head, in a manner such that the internal envelope, the external envelope and the flange form an indissociable whole.

This process comprises, preferably, a superficial joining together of the two sheets, a surface representing at least 50% of the total surface in contact remaining free to move.

Advantageously, this process comprises, among others, the following preliminary operation: folding of a sheet of supple material in a manner to realize at least two superposed layers.

The fitting of a non-return device advantageously comprises the following operations:

piercing of at least one orifice in the exterior envelope of the tubular body, and placing of a non-return valving member between the exterior envelope and the interior envelope.

According to another execution mode, this fitting of a non-return device comprises the following operations:

piercing of at least one orifice in the exterior envelope of the tubular body;

piercing of at least a second orifice in a median layer of the tubular body, the second orifices do not come opposite the first ones, and providing an overlap surface not glued between the axis of these first and second orifices, this overlap surface forming non-return valving member.

The object of the invention is also another manufacturing process of this dispensing packaging which comprises the following operations:

formation, starting with a sheet of supple material and without elastic memory, by folding, rolling up on itself and welding of this sheet, of a double tubular casing over from 5% to at least 50% of its exterior surface;

extrusion of a sleeve of more rigid and elastic material around this tubular casing;

construction of a non-return device;

closure of one of the extremities of the tubular body;

joining together to each other in hermetic manner of the layers forming the open extremity of the external envelope, and joining together to each other in hermetic manner of the layers forming the open extremity of the internal envelope, and joining together of the open extremity with the flange of a dispenser head, in a manner such that the internal envelope, the external envelope and the flange form an indissociable whole.

In this process, the folding and the welding are realized preferably in the following manner:

rolling up of the sheet on itself over at least one turn and a half in a manner to form the tubular casing, and welding of the edges of the sheet extending according to the axis of this casing with the surface adjacent to these edges, the two welds being disposed substantially one opposite the other.

Among the advantages of the invention, one can cite the possibility of applying this type of packaging to relatively low-priced products which benefit in that way of a quality packaging and a better conservation.

Another advantage lies in the low volume of raw materials necessary for the manufacturing.

Another advantage lies in the facility of changing the manufacturing parameters, in view of the simplicity of the manufacturing process.

Another advantage is due to the possibilities of variations of possible forms.

Another advantage is that the conception of the packaging ensures a good maintenance of the interior envelope which empties without formation of residual pockets.

BRIEF DESCRIPTION OF THE DIFFERENT FIGURES

Other details or advantages of the invention will be deduced from the description of a particular execution form made hereafter, reference being made to the attached drawings, in which:

FIGS. 6 to 8 are successive schematic views showing the progressive rolling up of the pile of sheets for the formation of the cover;

FIG. 9 is a cross-sectional view at the height of the valve from FIG. 6;

FIG. 16 is a cross-sectional view of rolled up sheets according to FIG. 14;

FIGS. 17 and 18 are cross-sectional views of another realization mode;

FIG. 20 is a cross-sectional view of a detail of realization of a non-return device.

DETAILED DESCRIPTION OF THE FIGURES

Figure 1:
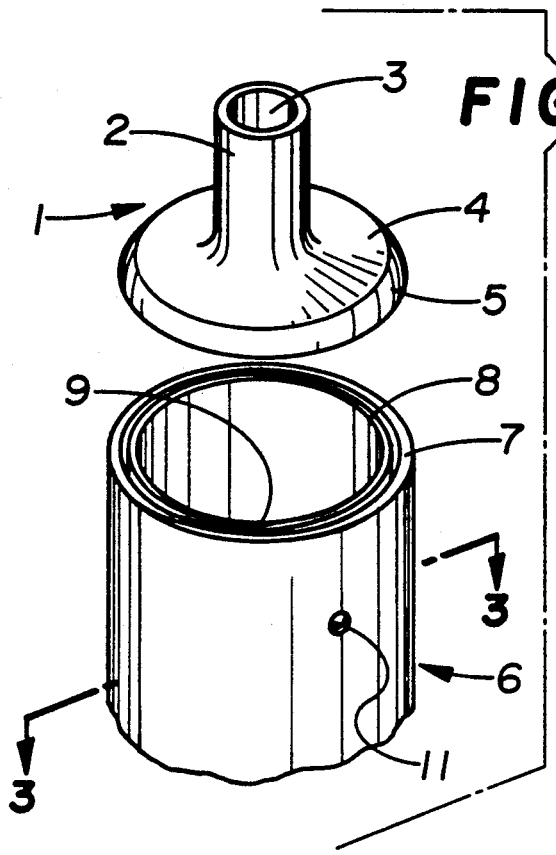
FIG. 1 is a schematic exploded view, in perspective, of a packaging according to the invention, at an intermediary stage of manufacture.

FIG. 1 shows in schematic manner two parts of the packaging according to the invention. The head 1 essentially comprises a dispensing nozzle 2 axially traversed by an orifice 3. One extremity of the nozzle is normally obturated by a detachable closure (not represented). The other extremity widens to form a flange. This flange 4 is provided, over its whole periphery, with a contact surface 5. The packaging also comprises a body 6 composed of two envelopes (7, 8) composed of materials of different rigidities, the more rigid and the more elastic material being disposed towards the exterior.

The wall of these two envelopes is rolled up on itself in a manner to form the tubular body 6 with closed section. A weld 9 effected parallel to the axis of this tubular body 6 keeps the walls (7, 8) in position in this configurations.

It is obvious that the weld 9 could be replaced by a line of glue (or any other means know to the craftsman) without departing from the scope of the invention.

Figure 2:
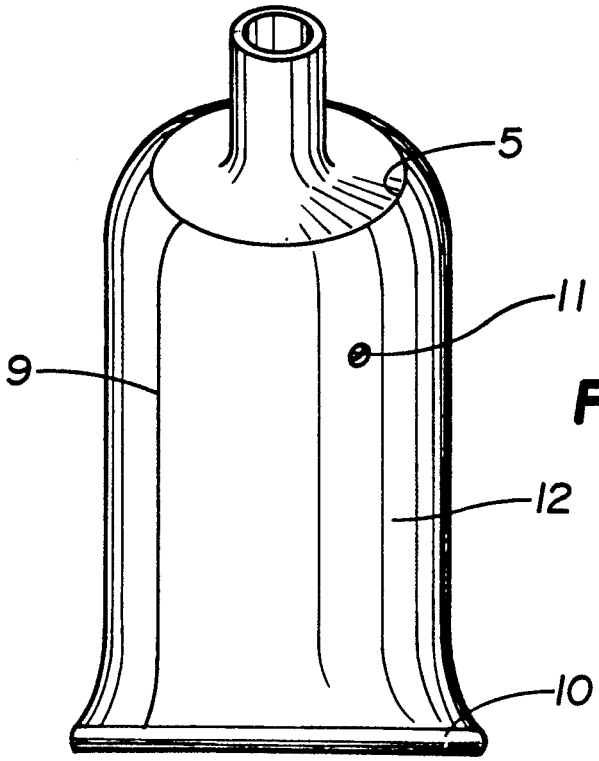
FIG. 2 is a view of the packaging from FIG. 1 at a completely finished stage.

FIG. 2 shows the same packaging in its finished form. The flange is connected to the tubular body and thus closes in hermetic manner the volume determined by each of the walls (7, 8) composing the body, one notes that in the terminal stage, the flange is totally merged with the two external 7 and internal 8 walls. The other extremity of the tubular body 6 is closed off by a weld 10 which joins together the whole of the layers to each other, so the layers form the internal envelope and the layers form the external envelope.

Figure 3:
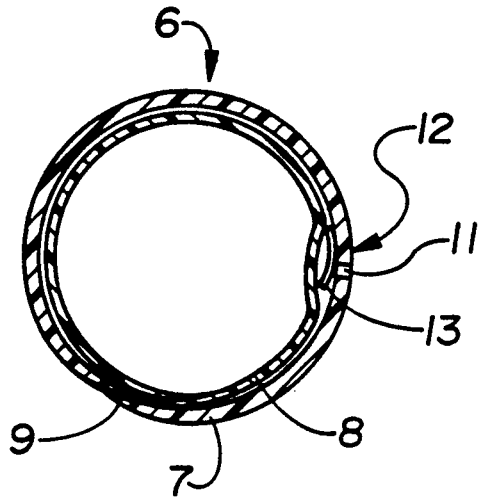
FIG. 3 is a cross-sectional view according to the plane III—III of the packaging from FIG. 1.

One sees, pierced in the external envelope 7, an orifice 11 which constitutes the outlet of a non-return device 12 of which the operation will be described in FIG. 3. This FIG. 3 shows the packaging 1 in cross-section at the height of the valve 12. The thicknesses of the walls have been accentuated intentionally.

The extremities of the walls 7, 8 are sealed together, hermetically one in relation to the other by the longitudinal weld 9. The internal sheet determines with the flange, on the one hand, and with the transverse weld, on the other, an envelope ("the internal envelope") which will be occupied by the paste product to which the packaging is destined.

At the exterior of the internal envelope, between this and the external wall 7, a second envelope ("the external envelope") extends also delimited on both sides by the flange and the transverse weld. This second envelope, initially reduced, when the packaging is full, contains air and communicates with the atmosphere by the opening 11. A valving member 13 obturates this opening 11—in unidirectional manner—in such manner that the air presses on the valving member 13 and cannot escape when one compresses the packaging, but can easily reenter when this pressure ceases.

The operation of this device is simple: when one presses the contours of the external wall 7, the air imprisoned in the external envelope 7 compresses the internal envelope 8 and provokes the expulsion of a determined quantity of the paste product. The internal wall 8, of low rigidity and practically without elastic memory, to a considerable extent retains the form imposed when the pressure on the external wall ceases, while the external wall 7, more rigid, quite rapidly regains its initial form by elastic "memory". At this moment a slight depression occurs in the external envelope 7, which normally produces the suction, through the valve 12, of a volume of air corresponding to the volume of the expelled product, the inertia of the internal envelope and the paste product itself, just as a slight restriction of the section of the orifice 3 (not represented) or a unidirectional device prohibiting the return of a significant quantity of air or the product in the internal envelope by the orifice 3.

In the realization mode shown in FIG. 2, the valve 12 can be replaced, according to the desired performances, by any other non-return device, preferably not onerous. One can thus limit oneself to a simple orifice that the user obturates when he presses the packaging, or even provide for a porous zone in the external wall 7, this zone of limited air flow provoking a negligible loss of air when one presses on the exterior envelope, but permitting it then gradually to regain its form thanks to its elastic memory.

As the quantity of the paste product reduces, the pouch formed by the internal envelope 8 reduces by the same. It is however held in position the whole way along by the longitudinal weld 9 and by gluing zones 14 which nevertheless do not take up more than half of its surface, in such manner to permit a progressive fold and an ejection as complete as possible of the paste product which it encloses and to avoid the obstruction of the nozzle 2 by the formation of a pocket in the internal wall.

Figure 4:
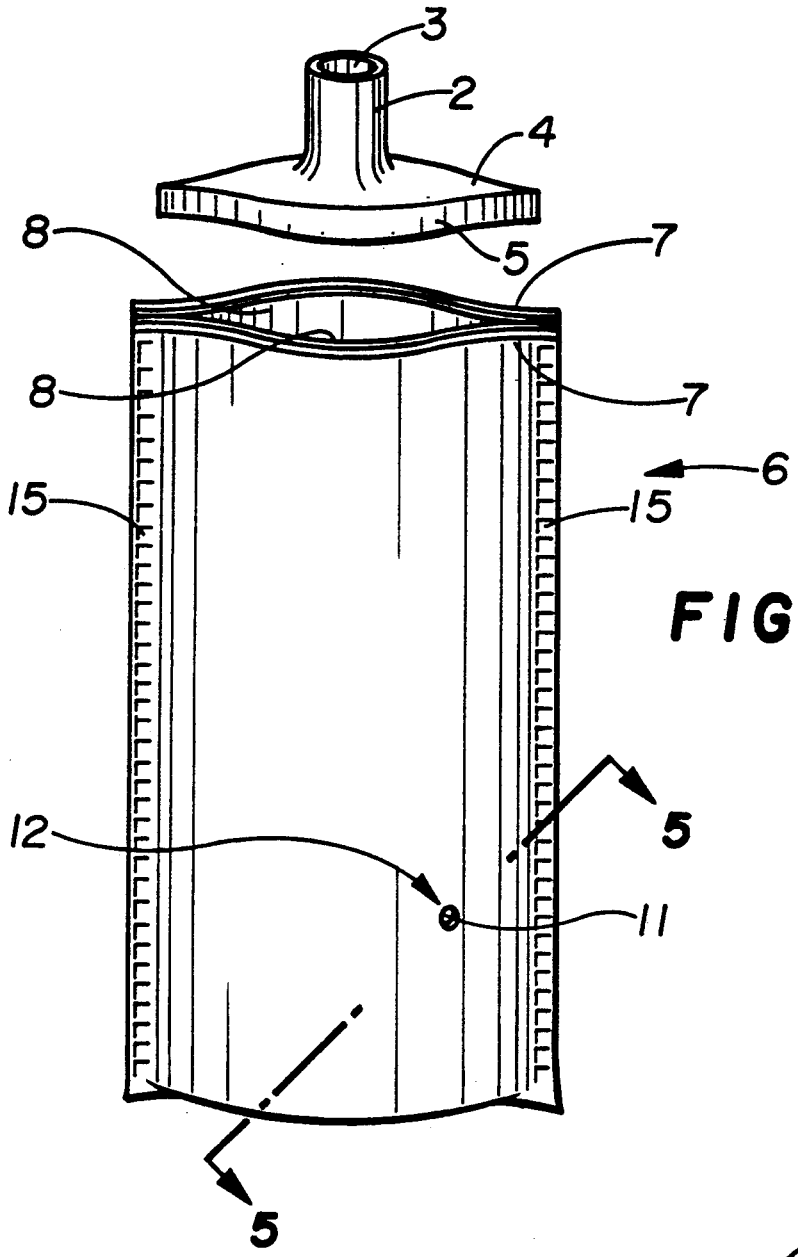
FIG. 4 is a schematic exploded view, in perspective, of another realization form of the packaging according to the invention.

FIG. 4 shows another realization form of a packaging according to the invention. In this one, the body 6 is formed by folding double in the direction of the length two superposed sheets 7, 8 of different rigidities, the layer 7 the more rigid being always turned towards the exterior. The body 6 is sealed according to its axis by two joints 15 joining together (by welding or by gluing) the longitudinal edges of these sheets folded double. A dispensing nozzle 2 is fixed, by a flange 4 of adequate form, to the free edge of the body 6 thus formed.

One thus disposes of two independent volumes, an internal envelope communicating with the orifice 3 of the dispensing nozzle 2, delimited by the internal sheet 8, the two joints 15 and the flange 4, and, on the other hand, the "external" volume between the internal envelope 8 and the external envelope 7, it also delimited by the two joints 15 and the flange 4. One notices that here too the two envelopes 7, 8 are merged (indeed fused) with the flange 4 at the level of its contact surface 5.

Figure 5:
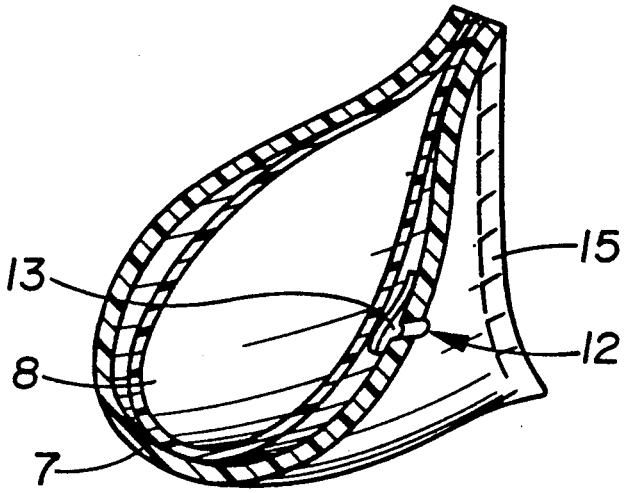
FIG. 5 is a cross-sectional view according to the plane V—V of a detail from FIG. 4.

The external volume communicates through the orifice 3 with the atmosphere. A valving member 13, situated on the internal face of the external envelope 7, acts as non-return device 12, as one sees in a more detailed manner in FIG. 5.

The manufacturing process of a packaging according to the invention is fast and not onerous and its elements are found back in the described figures. According to a first form of the process, one starts with sheets of materials presenting two different rigidities 16, 17 (by their nature or by their thickness). For a continuous manufacture, these sheets are generally mechanically set apart in advance on continuous unwinding rollers. After superposition, the sheets 16, 17 are rolled up on themselves and welded to form a tubular sleeve 18. One can also provide a gluing of the two envelopes 7, 8 over at least a part of their perimeter. The sections are cut off at length and a non-return device 12 is inserted or provided in the body 6. A welding or a gluing of the end permits the insertion of the flange 4 supporting the nozzle 2 on the body 6. The packaging is terminated by the welding by pinching of the other extremity 10 of the body or its insertion on a base. According to the required qualities, one can also start with a single sheet 19, of plastic material for example, which, for manufacturing, is first folded double on itself and glued between two folds, in such a manner to form a thicker and more rigid composite exterior. This sheet folded double is utilized as a superposition of sheets, rolled up on itself and welded to form a sleeve as described further above. A glued sheet reacts better than would an identical sheet presenting a double thickness. The gluing layer 20 in fact also participates by its intrinsic mechanic properties and by its thickness, in the properties of the envelope.

FIGS. 6 and 10 to 13 show different ways of disposing the sheets in order to realize the body of a packaging according to the invention.

These different figures show the aspect of the sheets 16, 17 piled up prior to their being shaped in order to realize the body 6 of the packaging, which permits a better understanding of the details of the packaging and of its manufacturing process.

FIG. 6 shows, in perspective, a pile comprising a supple sheet 16 and a more rigid sheet 17, in this case of approximately rectangular form. These sheets present two longitudinal sides 21, 22 and two transverse sides 23. A means of joining together 20 (some glue, in this case) is distributed between the sheets 16, 17; this joining together is nevertheless distributed in such manner as not to impede the movements of the sheets over more than 50% of their surface. The non-return device, such as it appears in cross-section in FIG. 9, here comprises a valving member 13 coming to obtrude the orifice 11 pierced in the more rigid layer 17. In order to realize the body 6 of the packaging according to the invention, one brings together the longitudinal sides 21, 22 or the transverse sides 23, 23 in such manner as to obtain the successive configurations shown in FIGS. 7 and 8, and finally a tubular form 18. The two edges in contact 21, 22 or 23, 23 are joined in order to maintain this form.

Figure 10:
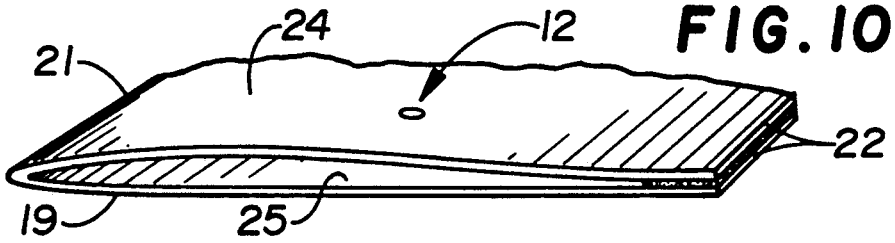
FIGS. 10 to 14 are schematic views in transverse section of other realization modes of the packaging according to the invention.

FIG. 10 shows another basis for departure for realizing, according to the same process, a packaging according to the invention. A single sheet 19, of unequal thickness, is folded in two according to a longitudinal axis. One obtains two superposed layers 24, 25 of different rigidity. As for the preceding example, the rolling up can be done according to a longitudinal axis, parallel to the folding, or according to a transverse axis, perpendicular to this.

The two thicknesses 24, 25 are partially glued (while conserving their relative liberty over at least 50% of the surface). As in FIG. 9, a valving member 13 is inserted on the more rigid face 24, at the height of an orifice in such manner to realize a non-return device 12.

Diverse methods permit two different rigidities to be obtained starting with one same sheet. As described in FIG. 10, one can utilize a sheet 19 presenting, over its width, variable thicknesses, or glue several successive thicknesses of one same sheet. One can also, at the time of manufacture, impress a certain curve to a sheet. The part of this curved sheet, destined to form the exterior envelope 7, is worked while conserving the direction of its initial curvature. The part destined to form the interior envelope 8, on the contrary, is turned over by the folding and being shaped in opposition to its initial curve, from where a loss of elasticity which differentiates it from the exterior envelope 7.

It is also possible, by a simple mechanical treatment (trituration for example) of a part of the width of the original sheet, to obtain different mechanical qualities, propitious to the effect desired in the packaging according to the invention.

One can remark, finally, that the double fold necessary for the formation of the two envelopes can also be obtained by the flattening, more or less according to a plane, of the section of casing manufactured in the adequate material or materials. This flattened casing is then folded over on itself, as shown in FIGS. 7 and 8 in order to form a new tubular body 18.

Figure 11:
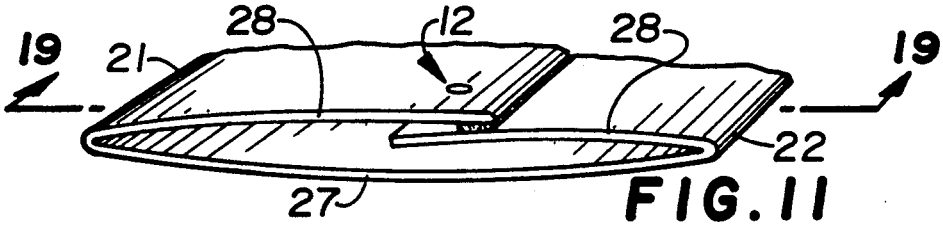
Figure 19:
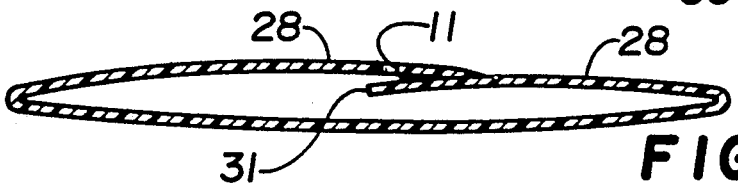
FIG. 19 is a cross-sectional view of a detail from FIG. 11.

FIG. 11 shows another form of a pile of sheets capable of being rolled up in order to realize the body of a packaging according to the invention. As for example from FIG. 9, it concerns a sheet 26 of unequal thickness. The thinnest part 27 forms the lower layer. The two thicker free extremities 28, 29 of the original sheet 26, form the upper layer. They are joined by a welded juncture 30 which will remain visible after rolling up since it is part of the exterior envelope 7. Such a realization shows that the sheets forming the interior and exterior envelopes can be interrupted without that detracting in any way from the good operation of the packaging. Consequently, it is possible to integrate intermediate operations into the manufacturing process of the packaging according to the invention without departing from the basic conception. In other respects, with reference to FIG. 19, one ascertains that this mode of manufacture permits the easy realization of a non-return device 12. At the time of lap-welding, one leaves the extremity 31 of the overlapped part to stick out slightly underneath; this part 31 comes to apply itself just like a valving member on the orifice 11 provided near the weld 30. Such a valve can also be provided in a median layer, of less elasticity, the orifice of the valve being placed facing an orifice 11 provided in the exterior envelope; the efficiency of the valving member thus formed can be improved by a longitudinal groove, which weakens the section, or still by two transverse grooves which reduce the length.

Figure 12:
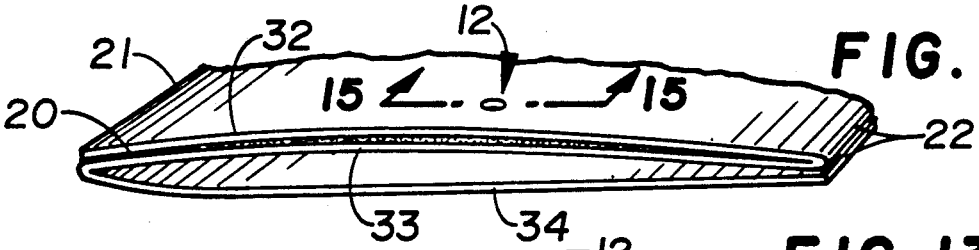
Figure 13:
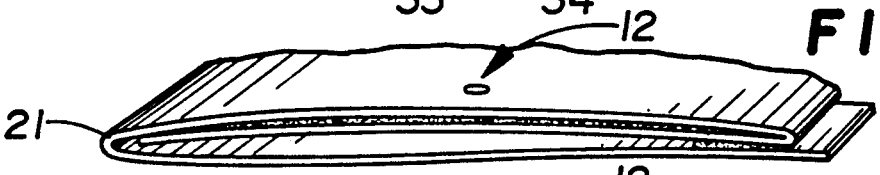
Figure 15:
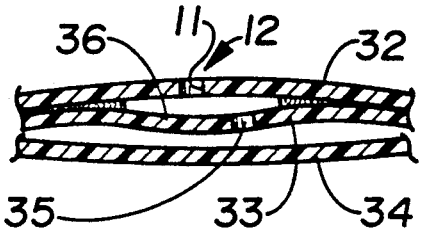
FIG. 15 is a cross-sectional view at the height of the valve from FIG. 12.

FIG. 12 and 13 illustrate the possibility of realizing a packaging body starting from a sheet 32, 33, 34 folded over twice on itself, in such manner to obtain three layers 32, 33, 34 of superposed material. Prior to the folding, one realizes perforations 11, 35 in two of the folds, disposed in such manner not to come facing one another. As one sees in FIG. 15, the tongue 36 of supple material separating these two perforations 11, 33 ensures the operation of a non-return valving member 12, still improved by the curve which occurs at the time of manufacture of the body 6 of the packaging. The form and the dimensions of the holes 11 and 35 depend on the rigidity of the plastic utilized. The fold 32 destined to be turned towards the exterior and the median fold 33 are joined together, by gluing 20 for example (with the exception of the zone surrounding the perforations), in such manner to obtain a "double" wall, more rigid than the "single" layer of the interior envelope 34 and which therefore functions perfectly according to the principle of the invention. One will remark that the folding can be done in Z as in FIG. 11 or in crossed folds as in FIG. 12.

Figure 14:
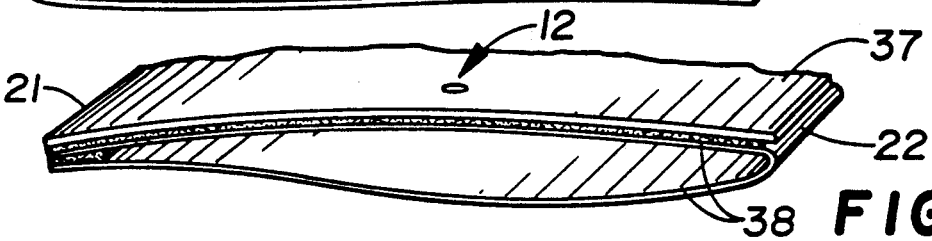

One can still combine the sheets of materials in different manners. In FIG. 14, two sheets 37, 38 of different materials are utilized: one sheet 37 of more rigid material and one sheet 38 of more supple material, the latter folded in two. The first envelope 37 is obtained by joining together the first sheet 38 and one of the folds of the second sheet, in realizing the non-return device 12 according to the method described further above. The second envelope 8 is realized by joining together the longitudinal edges of the second sheet 38. The whole is rolled up as described previously (FIGS. 7, 8) in order to form the body 6 of the packaging.

FIG. 16 shows the section of a body rolled up utilizing a structure as described in FIG. 14. As one can see, it is possible, at the time of the superposition, to decenter the sheets 37, 38 slightly in relation to each other, which permits notably the realization of economies of material and the improvement of the technical qualities of the packaging.

According to the technical necessities to which the packaging must correspond, in order to realize it one can be led to superposing an undetermined number of layers, obtained either by successive foldings of one or several sheets, or by the piling up of distinct sheets, which are then rolled up on themselves and welded.

FIGS. 17 and 18 illustrate another realization form of the body of the packaging according to the invention. The body of the packaging shown in FIG. 17 comprises an internal envelope 8, a median layer 39 constituted of the same material as the internal envelope 8, and a more rigid exterior envelope 40. The internal envelope 8 and the median layer 39 are constituted by the folds of one same original sheet 8, 33, folded in two and rolled thus on itself in such manner to form a tubular cover. The two longitudinal edges 41 of the original sheet 8, 39 are welded to its median fold 42, so well that the two folds 8, 39 determine two almost concentric volumes, isolated one in relation to the other. Around the median layer 39, and adhering for the greater part to this, the exterior envelope 40 is disposed, which encloses without discontinuity the whole body 6 of the packaging.

Concerning the manufacturing process, the exterior layer 40 is for example extruded around this tubular form and glued to this, with the exclusion of a reserved zone 43 necessary for the realization of a non-return device 12, and which extends around the orifices 11, 35.

FIG. 18 shows a particular realization based on the same principle. One starts here from a sheet of supple material which one rolls on itself over about one turn and a half. Each longitudinal edge 41 is welded on the surface which is adjacent to it. One thus obtains two envelopes 7, 8 endowed with a common wall 44 which is at one and the same time part of the "internal" envelope 8 and of the median layer of the "external" envelope 7. The exterior layer 40 is extruded around this whole in order to form with the median layer, the exterior envelope 7 of the packaging.

FIG. 20 shows another, very advantageous, manner of realizing a non-return device. In this realization form, the exterior envelope 7 presents an orifice 11. The edges of the sheet forming the interior envelope 8 presenting a strong overlap and are welded longitudinally by a weld 9, in a manner such that a free edge 31 extends in the interval between the interior envelope 8 and the exterior envelope 8 and comes facing the orifice 11. This free edge 31 assumes the role of a valving member opposite the orifice 11 and with this forms a non-return device 12. The keeping in position of the relative positions of the two envelopes 7, 8 is ensured by a gluing 20 disposed in proximity of the valve 12.

It will be clearly evident for the craftsman that each time allusion is made in the present application to an assemblage or to a joining together, this operation can be obtained either by welding, or by spot welding, or by gluing, or by sealing, by other means of sealing appropriate to sheets in plastic or composite material, possibly comprising a metallic or metallized pellicle.

That which is claimed:

1. Dispensing packaging for pasty and viscous products comprising a dispenser head, a tubular body (6), the dispenser head including a nozzle (2) traversed by a discharge opening (3), the discharge opening (3) of the nozzle (2) being obturable at its extremity by a detachable closure and the dispenser head connected by its other extremity to a flange (4) having a periphery, the flange being opposite of the discharge opening;

the body (6) extending according to an axis and including an interior envelope (8) and an exterior envelope (7), the exterior envelope surrounding the interior envelope, these two envelopes (7, 8) being closed at one extremity of the body (6) and being, at the other extremity, connected to each other and to the periphery (5) of the flange (4) of the dispenser head;

the interior envelope (8) being supple and devoid of elastic memory and suitable for containing pasty and viscous products;

the exterior envelope (7) being more elastic and more rigid than the interior envelope (8), and deformable under the effect of a manual compression force and capable of resuming its initial form when the compression force ceases to be applied;

a non-return device (12) including an orifice (11) formed in the exterior envelope (7) and a valving member (13) disposed on the interior of the exterior envelope (7) so as to selectively cover the orifice (11) when the exterior envelope (7) is deformed for prohibiting the passage of air from the volume between the exterior envelope (7) and the interior envelope (8) when the exterior envelope (7) is compressed, but permitting the passage of the ambient air towards this volume when the compression force ceases to be applied;

wherein the two envelopes are coupled and formed together, said envelopes (7, 8) being united and merged with the flange (4) of the dispenser head, and thus held in position at the periphery of the aforesaid flange (4) and on at least two points opposite the aforesaid dispenser head.

2. Packaging according to claim 1, wherein the non-return device further comprises the valving member (13) disposed on an internal face of the exterior envelope facing the orifice, a zone where the exterior envelope (7) and the interior envelope (8) are not joined together surrounding the orifice (11) and the valving member (13).

3. Packaging according to claim 1, wherein the two coupled envelopes are made up of two sheets of materials bordered by edges extending parallel to the axis of the body rolled up (16,17) on themselves around said axis, said edges being lap-jointed by at least one weld (9) extending parallel to said axis.

4. Packaging according to claim 1 wherein the extremity of the tubular body opposite to the dispenser head is closed by a weld.

5. Packaging according to claim 1 wherein the extremity of the tubular body opposite to the dispenser head is closed by a base having a periphery, the two envelopes being united and merged at the periphery of the base.

6. Packaging according to claim 1 wherein the exterior envelope is formed by at least two underlayers, a median layer and an exterior layer, the median layer and the interior envelope being constituted of a same piece of material.

7. Packaging according to claim 6, wherein the exterior layer of the exterior envelope is a continuous tube, extending according to the axis of the body, the median layer and the interior envelope being formed of a same sheet of supple material bordered by longitudinal edges extending parallel to the axis of the body, and the width of which extend perpendicular to the axis of the body, folded over itself parallel to the axis of the body, the median layer and the exterior layer being joined to form a whole exterior envelope offering a greater rigidity than that of the interior envelope.

8. Packaging according to claim 7, wherein the sheet of supple material forming the median layer (39) and the internal envelope (8) is (16) folded in two over itself in the direction of the width, forming a fold, the aforesaid folded over sheet being rolled up on itself parallel to the axis of the body, so that its two longitudinal edges are contiguous and attached to the fold (42) of the sheet.

9. Packaging according to claim 7, wherein the sheet of supple material forming the median underlayer (30) and the interior envelope (8) is (16) rolled up on itself according to its width at least one turn, its longitudinal edges each being joined by an axial weld (45) to the interior surface of the exterior envelope.

10. Packaging according to claim 9 wherein the sheet of supple material (16) is rolled up on itself by about one turn and a half inside the continuous tube forming the exterior layer of the exterior envelope (10).

11. Dispensing packaging for pasty and viscous products comprising a dispenser head, a body (6), the dispenser head including a nozzle (2) traversed by a discharge opening (3), the discharge opening (3) of the nozzle (2) being obturable at its extremity by a detachable closure and the dispenser head connected by its other extremity to a flange (4) having a periphery, the flange being opposite of the discharge opening;

the body (6), being tubular, extending according to an axis and including an interior envelope (8) and an exterior envelope (7), the exterior envelope surrounding the interior envelope, these two envelopes (7, 8) being closed at one extremity of the body (6) and being, at the other extremity, connected to each other and to the periphery (5) of the flange (4) of the dispenser head;

the interior envelope (8) being supple and devoid of elastic memory and apt for containing a paste or viscous product;

the exterior envelope (7) being more elastic and more rigid than the interior envelope (8), and deformable under the effect of a manual compression force and capable of resuming its initial form when the compression force ceases to be applied;

a non-return device (12) including an orifice (11) formed in the exterior envelope (7) and a valving member (13) disposed on the interior of the exterior envelope (7) so as to selectively cover the orifice (11) when the exterior envelope (7) is deformed for prohibiting the passage of air from the volume between the exterior envelope (7) and the interior envelope (8) when the exterior envelope (7) is compressed, but permitting the passage of the ambient air towards this volume when the compression force ceases to be applied;

wherein the two envelopes are coupled and formed together, the envelopes (7, 8) being united and merged with the flange (4) of the dispenser head, and thus held in position at the periphery of the aforesaid flange (4) and on at least two points opposite the aforesaid dispenser head, the interior envelope being formed of a sheet of which the edges are lap-welded, the overlap of the edges of this sheet and the position of the weld being such that a free extremity (31) subsists towards the exterior of the internal envelope, the external envelope (7) and the internal envelope (8) being joined together one in relation to the other so that the free extremity (31) is facing the orifice (11) and forms the valving member for the aforesaid orifice, this disposition forming the non-return device (12).

12. Dispensing packaging for pasty and viscous products comprising a dispenser head, a body (6), the dispenser head including a nozzle (2) traversed by a discharge opening (3), the discharge opening (3) of the nozzle (2) being obturable at its extremity by a detachable closure and the dispenser head connected by its other extremity to a flange (4) having a periphery, the flange being opposite of the discharge opening;

the body (6), being tubular, extending according to an axis and including an interior envelope (8) and an exterior envelope (7), the exterior envelope surrounding the interior envelope, these two envelopes (7, 8) being closed at one extremity of the body (6) and being, at the other extremity, connected to each other and to the periphery (5) of the flange (4) of the dispenser head;

the interior envelope (8) being supple and devoid of elastic memory and apt for containing a paste or viscous product;

the exterior envelope (7) being more elastic and more rigid than the interior envelope (8), and deformable under the effect of a manual compression force capable of resuming its initial form when the compression force ceases to be applied;

a non-return device (12) including an orifice (11) formed in the exterior envelope (7) and a valving member (13) disposed on the interior of the exterior envelope (7) so as to selectively cover the orifice (11) when the exterior envelope (7) is deformed for prohibiting the passage of air from the volume between the exterior envelope (7) and the interior envelope (8) when the exterior envelope (7) is compressed, but permitting the passage of the ambient air towards this volume when the compression force ceases to be applied;

wherein the two envelopes are coupled and formed together, the envelopes (7, 8) being united and merged with the flange (4) of the dispenser head, and thus held in position at the periphery of the aforesaid flange (4) and on at least two points opposite the aforesaid dispenser head, wherein the non-return device (12) further comprise at least one orifice (35) pierced in the medium layer, the overlap surface (36) of supple material between these two orifices (11, 35) forming the non-return valving member (13), a zone in which the exterior envelope and the median underlayer are not joined together surrounding the aforesaid valving member (13).

13. Dispensing packaging for pasty and viscous products comprising a dispenser head, a body (6), the dispenser head including a nozzle (2) traversed by a discharge opening (3), the discharge opening (3) of the nozzle (2) being obturable at its extremity by a detachable closure and the dispenser head connected by its other extremity to a flange (4) having a periphery, the flange being opposite of the discharge opening;

the body (6), extending according to an axis and including an interior envelope (8) and an exterior envelope (7), the exterior envelope surrounding the interior envelope; these two envelopes (7, 8) being closed at one extremity of the body (6) and being, at the other extremity, connected to each other and to the periphery (5) of the flange (4) of the dispenser head;

the interior envelope (8) being supple and devoid of elastic memory and suitable for containing the pasty and viscous products;

the exterior envelope (7) being more elastic and more rigid than the interior envelope (8), and deformable under the effect of a manual compression force and capable of resuming its initial form in substance when the compression force ceases to be applied;

a non-return device (12) including an orifice (11) formed in the exterior envelope (7) and a valving member (13) disposed on the interior of the exterior envelope (7) so as to selectively cover the orifice (11) when the exterior envelope (7) is deformed for prohibiting the passage of air from the volume between the exterior envelope (7) and the interior envelope (8) when the exterior envelope (7) is compressed, but permitting the passage of the ambient air towards this volume when the manual compression force ceases to be applied;

wherein the two envelopes are coupled and formed together, the envelopes (7, 8) being united and merged with the flange (4) of the dispenser head, and thus held in position at the periphery of the aforesaid flange (4) and on at least two points opposite that aforesaid dispenser head;

and wherein the two coupled envelopes are formed of two superposed sheets of materials folded over in two according to an axis perpendicular to the axis of the body (6), lap-welded on their sides extending according to the axis of the body (6), their free extremities being connected to the periphery (5) of the flange (4) of the dispenser head.

* * * * *